US005353565A

United States Patent [19]

Tanikawa

[11] Patent Number: 5,353,565

[45] Date of Patent: Oct. 11, 1994

[54] LOUVERED WINDOW ASSEMBLY

[75] Inventor: Shinji Tanikawa, Marietta, Ga.

[73] Assignee: YKK Corporation, Lyndhurst, N.J.

[21] Appl. No.: 939,732

[22] Filed: Sep. 2, 1992

[51] Int. Cl.[5] ..... E06B 7/08

[52] U.S. Cl. ..... 52/473; 52/202; 52/203

[58] Field of Search ..... 52/473, 202, 203; 49/51, 64; 160/104, 107

[56] References Cited

U.S. PATENT DOCUMENTS

| | | | |
|---|---|---|---|
| 2,115,935 | 5/1938 | Stinson . | |
| 2,181,585 | 11/1939 | Nothdurft . | |
| 2,309,717 | 2/1943 | Siebenlist . | |
| 3,181,661 | 5/1965 | Cochran | 52/473 |
| 3,577,864 | 5/1971 | Sommerfield . | |
| 3,634,991 | 1/1972 | Barton, Jr. et al. | 52/718 |
| 3,771,430 | 11/1973 | Lane . | |
| 3,880,391 | 4/1975 | Gianardi . | |
| 3,886,703 | 6/1975 | Rousey | 52/473 |
| 3,981,525 | 9/1976 | Mayes | 292/259 R |
| 4,006,933 | 2/1977 | Simpson | 52/473 |
| 4,018,024 | 4/1977 | Stelzer | 52/473 |
| 4,251,961 | 2/1981 | Deibele | 52/202 |
| 4,369,828 | 1/1983 | Tatro | 160/107 |
| 4,409,960 | 10/1983 | Balzer | 160/107 |
| 4,444,239 | 4/1984 | Haines | 160/107 |
| 4,452,020 | 6/1984 | Werner | 52/202 |
| 4,783,938 | 11/1988 | Palmer | 52/456 |

FOREIGN PATENT DOCUMENTS

| | | | |
|---|---|---|---|
| 2674607 | 10/1992 | France | 160/104 |
| 2136487 | 9/1984 | United Kingdom | 52/309.1 |

*Primary Examiner*—Peter M. Cuomo
*Assistant Examiner*—Darnell M. Boucher
*Attorney, Agent, or Firm*—Finnegan, Henderson, Farabow, Garrett & Dunner

[57] ABSTRACT

A louvered window assembly comprises a fixed window unit B fixedly fitted on a rear side within a window opening A, a louver unit C being slightly less in height and width than the window opening A and to be fitted on a front side within the window opening A, and means for releasably fitting the louver unit C within the window opening A. The louver-unit fitting means comprises a support bracket 31 fastened to the front side of the fixed window B, a hanger bracket 32 fastened to the rear side of the louver unit C and coming into engagement with the support bracket 31, a louver header 20 fastened to the front side of an upper inside surface A3 of the window opening A, a pair of louver jambs 22, 22 fastened one on the front side of each vertical inside surface A3, an upper horizontal clip 40 joined to the front side of the header 20 so as to cover the front side of an upper edge of the louver unit C; and a pair of vertical clip 45 joined one to the outside of each louver jamb so as to cover the outside of the lateral edge of the louver unit C.

6 Claims, 5 Drawing Sheets

LOUVERED WINDOW ASSEMBLY

BACKGROUND OF THE INVENTION

1. Field of the Invention

The present invention relates to a louvered window assembly comprising a fixed window unit fixedly fitted on a rear side within a window opening and a louver unit releasably fitted on a front side within the window opening.

2. Prior Art

One typical example of conventional simple louver units is disclosed in U.S. Pat. No. 2,309,717. This conventional louver unit includes a frame having front flanges and on the respective sides thereof and top and bottom flanges and, the flanges being suitably united at the respective corners of the frame. A plurality of louver slats are located within the opening defined by the frame. A wood frame is nailed around an opening cut in a wood frame wall. For installing the louver unit, the frame is fitted into the opening and then securely held in place to the opening by either nailing or screwing the front flanges and top and bottom flanges and to the wood frame.

This type of conventional louver unit has suffered drawbacks. Nailing or screwing of all flanges of the louver unit frame to the wood frame is quite tedious and time-consuming. This would reflect tediousness on the user of this louver unit in replacement.

A louvered window assembly comprising a fixed window and a Venetian blind is shown in U.S. Pat. No. 2,115,935. In this conventional construction, a glass pane is fixedly mounted inside of a window opening. A pair of brackets are fastened at their upper legs to an upper surface of the window opening adjacent to the glass pane. A pivotal pin is fastened to the lower legs of the brackets. A blind unit comprises a pair of parallel upright support members and a plurality of parallel horizontal vanes fastened to the upright support members. The upright support members are hooked at their upper end and are pivotally mounted on the pivotal pin.

With such a construction, the blind unit may be readily and easily tilted relative to the inside window glass to permit the inside window glass to be washed with a tool. However, this type of conventional blind unit is disadvantageous in that, since being poor in strength to be attached to the window opening, the blind unit would be liable to unexpectedly swing or rattle under the force of the strong wind.

Besides, although being capable of turning of the pivotal pin, the blind unit cannot be detached from the window opening. Therefore, the blind unit must be held in a raised position throughout cleaning of the fixed window located inside.

SUMMARY OF THE INVENTION

With the foregoing difficulties in view, it is therefore an object of the present invention to provide a louvered window assembly which comprises a fixed window unit and a louver unit fitted on a rear side and a front side, respectively, within a window opening and in which the louver unit can be easily attached to and detached from the window opening, the louver unit can be secured firmly to the window opening and the louver unit as a whole is sightly and attractive in appearance.

It is another object of the invention to provide a louvered window assembly wherein a louver unit is watertight along its periphery.

It is still another object of the invention to provide a louvered window assembly wherein a louver unit can be located correctly relative to a fixed window and fastened thereto.

It is still another object of the invention to provide a multiple louver window assembly in which a plurality of louver units can be fitted easily in a window opening successively in a horizontal row, and watertightness is ensured between adjacent louver units.

According to the present invention, there is provide a louvered window assembly comprising a fixed window unit fixedly fitted on a rear side within a window opening, a louver unit being slightly less in height and width than the window opening and to be fitted on a front side within the window opening, and means for releasably fitting the louver unit within the window opening; the louver-unit fitting means comprising a support bracket fastened to the front side of the fixed window, a hanger bracket fastened to the rear side of the louver unit and coming into engagement with the support bracket, a louver header fastened to the front side of an upper inside surface of the window opening, a pair of louver jambs fastened one on the front side of each vertical inside surface, an upper horizontal clip joined to the front side of the header so as to cover the front side of an upper edge of the louver unit; and a pair of vertical clips joined one to the front side of each louver jamb so as to cover the front side of the lateral edge of the louver unit.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
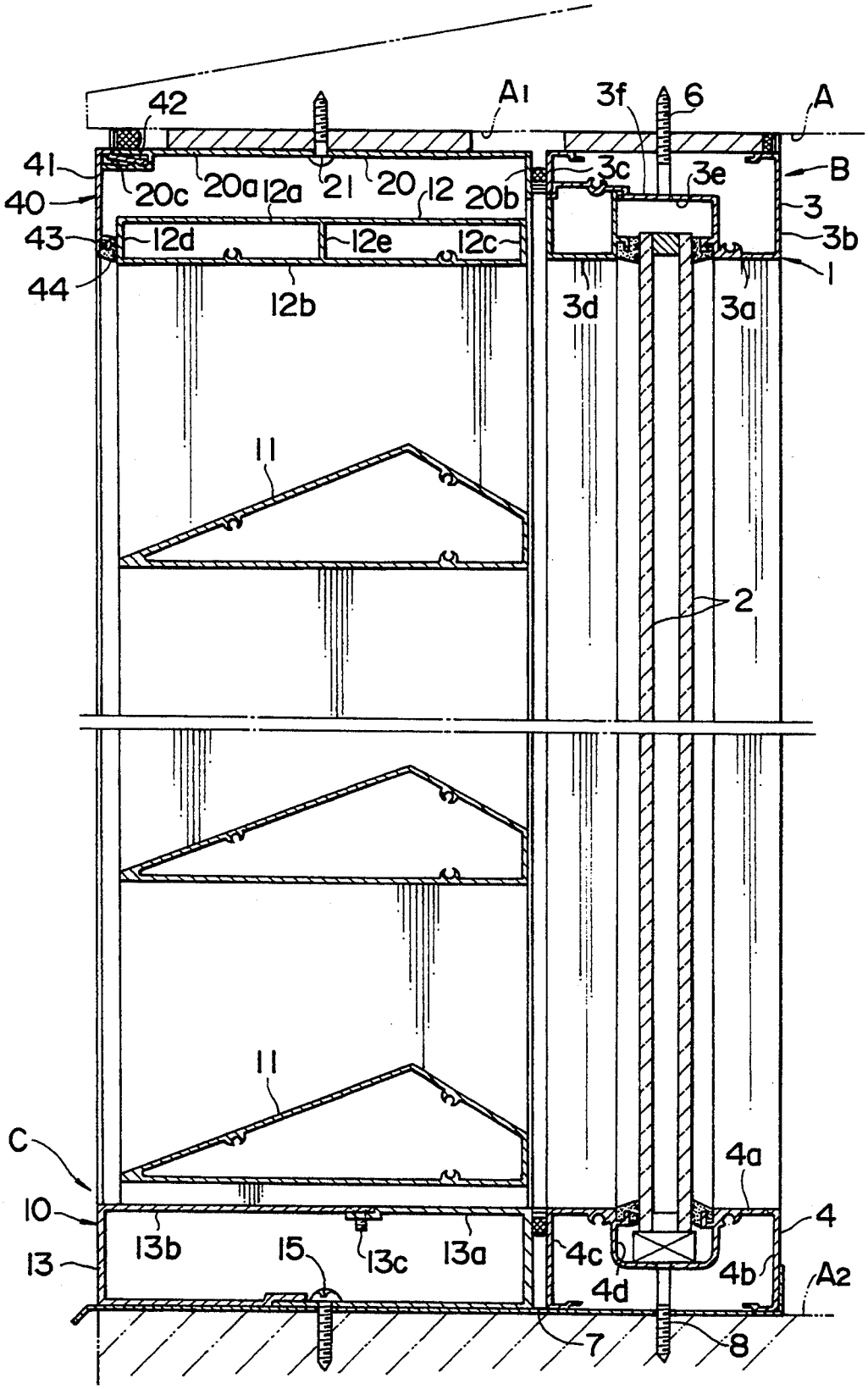
FIG. 1 is a vertical cross-sectional view of a louvered window assembly according to the present invention.
Figure 2:
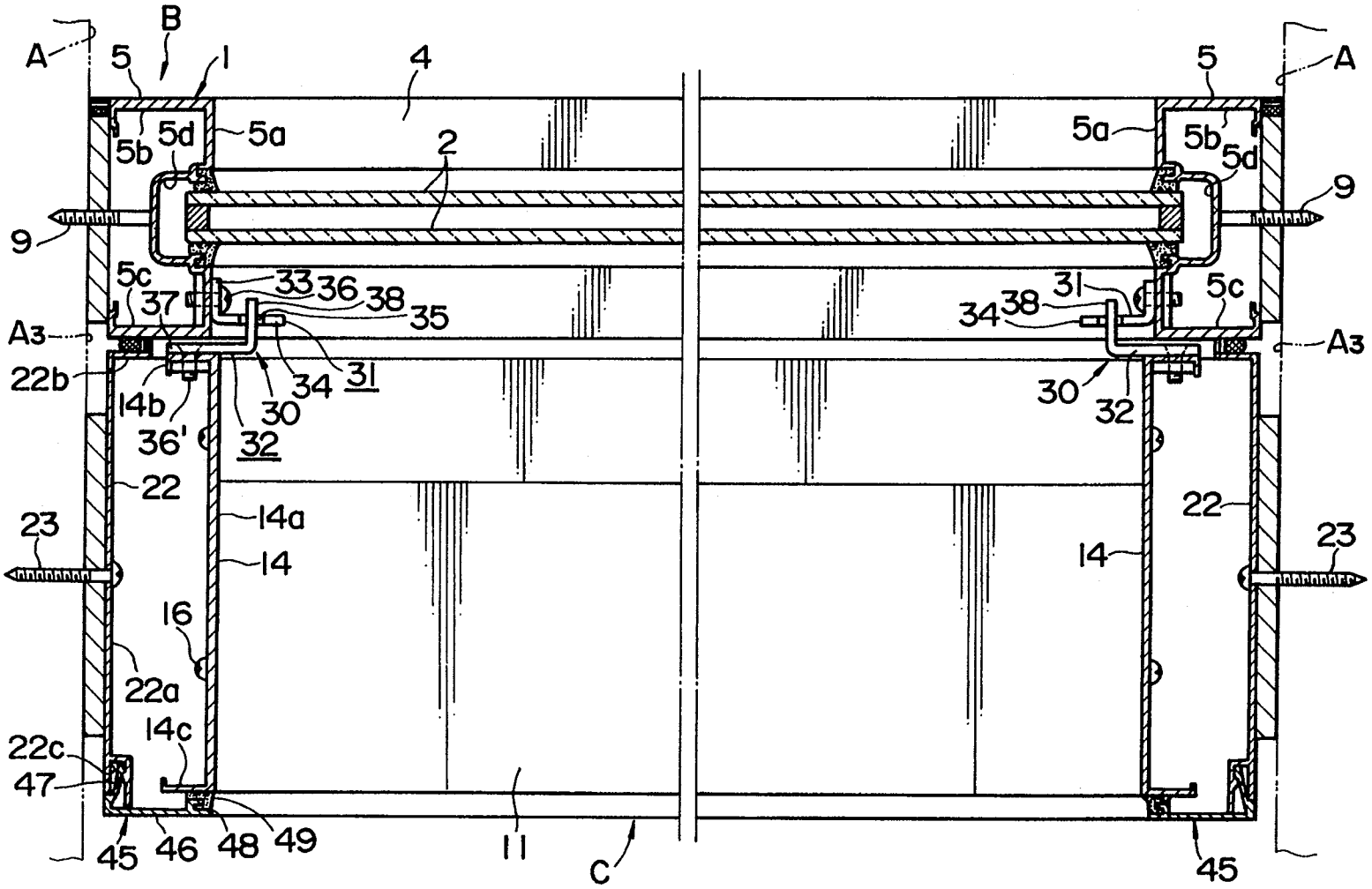
FIG. 2 is a horizontal cross-section view of the louvered window assembly of FIG. 1.

As shown in FIGS. 1 and 2, a louvered window assembly according to the present invention broadly comprises a fixed window unit B and a louver unit C fitted within a rectangular window opening A formed in a building wall, the fixed window unit B and the louver unit C located on the rear side and the front side, respectively, of the window opening A.

The fixed window unit B comprises a window frame 1 and double glass panes 2 fitted within the window frame 1. The window frame 1 is substantially rectangular and comprises a window header 3 and a window still 4 and a pair of window jambs 5, 5 each having its opposed ends with the corresponding ends of the window header 3 and the window sill 4.

As shown in FIG. 1, the window header 3 is an elongated profile of a substantially C-shaped cross-section and comprises a horizontal base plate 3*a*, a rear plate 3*b* and a front plate 3*c* provided on the opposed rear and front sides, respectively, of the base plate 3*a*. The base plate 3*a* is stepped upward at its intermediate position to provide a stepped portion 3*f*. A substantially C-shaped clip 3*d* is mounted beneath the front part of the stepped portion 3*f* of the base plate 3*a* to thus define, with the base plate 3*a*, a downward-open recess 3*e* which extends throughout the window header 3.

The window sill 4 is also of a substantially C-shaped cross-section and comprises a horizontal base plate 4*a*, a rear plate 4*b* and a front plate 4*c* provided on the opposed rear and front sides, respectively, of the base plate 4*a*. The base plate 4*a* is recessed in its middle to provide an upward-open recess 4*d* which extends throughout the window sill 4.

As shown in FIG. 2, each window jamb 5 is an elongated profile of a substantially C-shaped cross-section and comprises a base plate 5*a*, a rear plate 5*b* and a front plate 5*c* provided on the opposed rear and front sides, respectively, of the base plate 5*a*. The base plate 5*a* is recessed in the middle to provide an inward-open recess 5*d* which extends throughout the window jamb 5 and is open toward the opposite window jamb 5. The window header 3 and the window sill 4 have each its opposed ends fastened to the corresponding ends of the base plates 5*a*, 5*a* of the opposed window jambs 5, 5 by means of screws.

As shown in FIG. 1, the window window header 3 is fastened to the upper inner surface A1 of the window opening A by means of screws 6. A flashing 7 rests on the lower inner surface A2 of the window opening A. The window sill 4 is laid immediately on the flashing 7 and is fastened to the lower inner surface A2 of the rear side of the window opening A through the flashing 7 by means of screws 8. As shown in FIG. 2, the window jambs 5, 5 are each secured to the corresponding vertical inside surface A3 of the rear side of the window opening A by means of screws 9.

Turning now to the louver unit C, it broadly comprises a substantially rectangular louver frame 10 and a plurality of louver slats 11 arranged horizontally within and secured to the louver frame 10 as shown in FIG. 1. The louver frame 10 comprises a pair of upper and lower louver rails 12, 13 and a pair of louver stiles 14. 14 each having its opposed ends connected to the corresponding ends of the upper and lower louver rails 12, 13. It is to be noted that the louver frame 10 is slightly less in height and width than the window opening A. The upper louver rail 12 is an elongated profile of a rectangular cross-section and comprises a pair of horizontal upper and lower plates 12*a*, 12*b*, a pair of vertical front and rear plates 12*c*, 12*d* each connected at its upper and lower ends with the corresponding ends of the upper and lower plates 12*a*, 12*b*. Additionally, a vertical middle plate 12*e* extends between the upper and lower plates 12*a*, 12*b* at their middles. The lower louver rail 13 comprises a pair of front and rear complementary rail halves 13*a*, 13*b* of inverted and regular C-shaped cross-sections, respectively, the front and rear rail halves 13*a*, 13*b* being joined with each other by means of screws 13*c* to provide the elongated lower rail 13 of a hollow rectangular cross-section. The lower louver rail 13 is laid on the flashing 7 and is then fastened to the front side of the lower inner surface A2 of the opening A through the flashing 7 by means of screws 15. As shown in FIG. 2, each louver stile 14 is an elongated profile of a C-shaped cross-section and comprises a base plate 14*a*, a pair of front and rear flanges 14*c*, 14*b* provided on the opposed front and rear edges, respectively, of the base plate 14*a*.

The base plates 14*a*, 14*a* of the opposed louver stiles 14, 14 have each its upper end joined to the corresponding end of the upper louver rail 12. As better shown in FIG. 3, each louver slat 11 is an elongated hollow profile of a substantially triangular cross-section. As shown in FIGS. 1 and 2, the louver slats 11 are vertically spaced from each other and secured at its opposed ends to the base plates 14*a* of the opposed louver stiles 14 by means of screws 16.

As shown in FIG. 1, a louver header 20 is secured to the upper inner surface A1 of the front side of the window opening A by means of screws 21. The louver header 20 comprises a horizontal base plate 20*a*, a rear flange 20*b* provided integrally on the rear edge of the base plate 20*a* and an engaging groove 20*c* formed in the front edge of the base plate 20*a*. The engaging groove 20*c* extends throughout the louver header 20 and opens forward.

A pair of louver jambs 22, 22 are fastened, by screws 23 to the front side of the vertical inside surfaces of A3, A3 of the window opening in opposed relation to the louver stiles 14, 14. Each louver jamb 22 comprises a base plate 22*a*, a rear flange integrally provided on the rear edge of the base plate 22*a* and and an engaging groove 22*c* formed in the front edge of the base plate 22*a*. The engaging groove 22*c* extends throughout the entire length of the louver jamb 22 and opens forward.

The size of the louver frame 10 is such that, when the opposed louver stiles 14, 14 rest on the upper surface of the lower louver rail 13, the upper louver rail 12 be vertically spaced from the header 20 and the opposed louver stiles 14, 14 be horizontally spaced from the respective louver jambs 22, 22, respectively.

The louver stiles 14, 14 are located correctly relative to the window jambs 5, 5 in two horizontal directions (one direction is perpendicular to the general plane of the louvered window assembly and the other is parallel thereto) and retained thereto by means of a pair of connecting members 30, 30 described closely hereinbelow.

Figure 3:
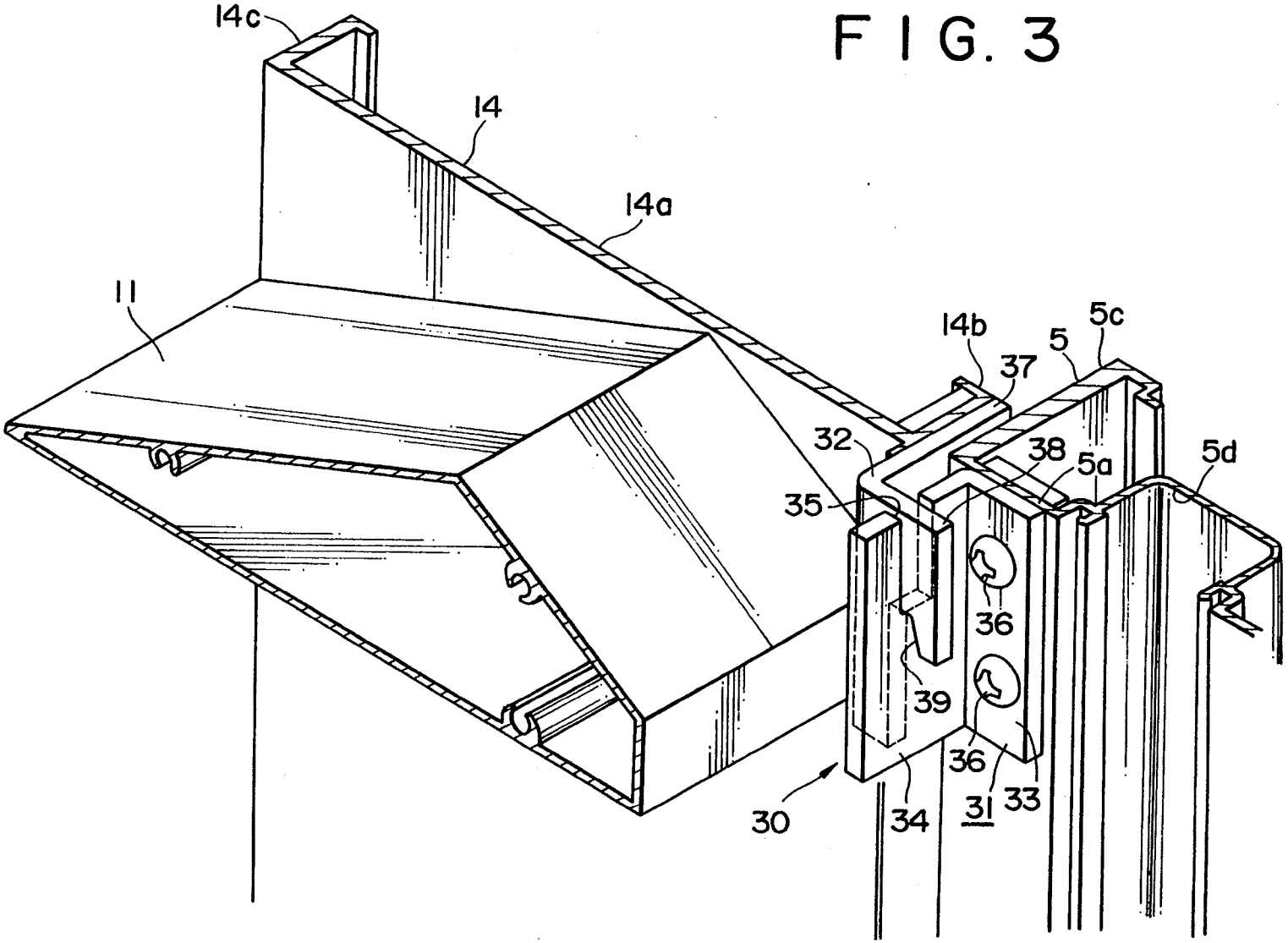
FIG. 3 is a perspective view showing a connecting member employed in the louvered window assembly of FIG. 1

As shown in FIGS. 2 and 3, each connecting member 30 comprises a support bracket 31 fastened to the window unit B and a hanger bracket 32 fastened to the louver unit C and engageable with the support bracket 31. As better shown in FIG. 3, the support bracket 31 is of a substantially L-shaped cross-section and comprises an attaching wing 33 and a supporting wing 34 provided integrally with the attaching wing 33 and arranged substantially normal to the attaching wing 33. The supporting wing 34 has a rectangular cut 35 formed in the upper edge thereto so as to be open upward. The support bracket 31 is fastened to the window jamb 5 by fastening the attaching wing 33 of the former to the base plate 5*a* of the latter by means of screws 36. As shown in FIG. 2, the support brackets 31. 31 of the opposed connecting members 30, 30 are fastened to the respective window jambs 5 with their supporting wings 34, 34 directed toward each other.

As better shown in FIG. 3, the hanger bracket 32 is also of a substantially L-shaped cross-section and comprises an attaching wing 37 and a hanging wing 38 provided integrally with the attaching wing 37 and arranged substantially normal to the attaching wing 37. The hanging wing 38 has a rectangular indentation 39 formed in the lower edge thereof so as to be open downward. As shown in FIG. 2, the hanger bracket 32 is fastened to the louver stile 14 by fastening the attaching wing 37 of the former to the rear flange 14*b* of the louver stile 14 by means of screws 36'. The hanger brackets 32, 32 are fastened to the respective louver stiles 14, 14 with their hanging wings 38, 38 both directed rearward.

The hanging wings 38, 38 of the opposed hanger brackets 32, 32 come into hanging engagement with the supporting wings 34, 34 of the respective support brackets 31, 31 by means of the indentations 39 and the cuts 35. This ensures that the upper louver rail 12 and the opposed louver stiles 14, 14 of the louver frame 10 be located correctly relative to the window frame 1 in the above-specified two horizontal directions and fastened thereto.

As shown in FIG. 1, an elongated upper horizontal clip 40 is attached to the louver header 20 as closely described hereinbelow. The upper horizontal clip 40 comprises a base plate 41, an engaging ridge 42 provided on the upper edge of the base plate 41 and a groove 43 formed in the lower edge of the base plate 41. The engaging ridge 42 of the upper horizontal clip 40 is snapped into the engaging groove 20*c* of the header 20 so that the upper horizontal clip 40 is attached to the louver header 20. An elongated gasket 44 is fitted into the groove 43 so that, when the upper clip 40 is attached to the louver header 20, the gasket 44 comes into pressing engagement with the vertical front plate 12*d* of the upper louver rail 12 for leakproofness.

As shown in FIG. 2, a pair of elongated vertical clip 45 are attached one to each louver jamb 22 as closely described hereinbelow. Each vertical clip 45 comprises a base plate 46, an engaging flange 47 integrally provided on an outer longitudinal edge thereof and an engaging groove 48 formed in an inner longitudinal edge thereof. It will be acknowledged that each vertical clip 45 has a cross-section identical with that of the upper horizontal clip 40. The engaging flange 47 of the vertical clip 45 is snapped into the engaging groove 22*c* of the louver jamb 22 so that the vertical clip 45 is attached to the louver jamb 22. An elongated gasket 49 is fitted into the groove 48 so that, when the vertical clip 45 is attached to the louver jamb 22, the gasket 49 comes into pressing engagement with the front flange 14*c* of the louver stile 14 for leakproofness.

Description is now made of the order of installing the louvered window assembly whose construction has been set forth hereinabove.

First, a fixed window unit B is fixedly fitted on a rear side of the window opening A. Since this step is well-known in the art, it is not necessary to make further reference thereto.

As shown in FIG. 1, the flashing 7 is laid over the lower inside surface A2 of the window opening A. The lower louver rail 13 is fastened to the front side of the lower inside surface A2, the louver header 20 is fastened to the front side of the upper inside surface A1 of the window opening A, and the louver jambs 20, 20 are fastened to the front sides of the vertical inside surfaces A3 of the opposed louver jambs 22, 22, respectively. Then, as shown in FIG. 2, the L-shaped support brackets 31, 31 are fastened to the base plates 5*a*, 5*a* of the opposed window jambs 5, 5, respectively, of the window frame 1 of the fixed window B. Alternatively, the fastening of the support brackets 31, 31 to the window jambs 5, 5 of the window frame 1 may be carried out beforehand when the window frame 1 is assembled in the workshop.

The hanger brackets 32, 32 are fastened to the respective louver stiles 14, 14 of the louver unit C. The louver stiles 14, 14 are, then, fastened to the upper louver rail 12.

The thus joined louver stiles 14, 14 and upper louver rail 12 are then inserted into the window opening A. Then, the joined louver stiles 14, 14 and upper louver rail 12 are raised within the opening A until the upper louver rail 12 almost touches the louver header 20 whereupon the rectangular indentations 39 of the hanger brackets 32 fastened to the louver stiles 14 are slightly higher than the rectangular cuts 35 of the support brackets 31 fastened to the window jambs 5.

Then, the joined louver stiles 14, 14 and rail 12 are lowered until the hanger brackets 32, 32 come into hanging engagement with the support brackets 31, 31, so that the joined louver stiles 14, 14 and upper louver rail 12 are correctly located relative to the window frame 1 in the two horizontal directions and then retained thereto.

As shown in FIG. 1, the upper horizontal clip 40 is attached to the louver header 20 with the gasket 44 fitted in the groove 43 of the horizontal clip 40 brought into pressing engagement with the vertical front plate 12*d* of the upper louver rail 12 so as to enclose the space between the upper louver rail 12 and the header 20 against leakage therethrough.

As shown in FIG. 2, the vertical clip 45 is attached to the louver window jamb 22 with the gasket 49 fitted in the groove 48 of the vertical clip 45 brought into pressing engagement with the front flange 14*c* of the louver stile 14 so as to enclose the space between the louver jamb 22 and the louver stile 14 against leakage therethrough.

If detachment of the joined stiles 14, 14 and upper louver rail 12 from the opening A is desired as for replacement or repair, then the above-mentioned steps have only to be taken in reverse order.

Figure 4:
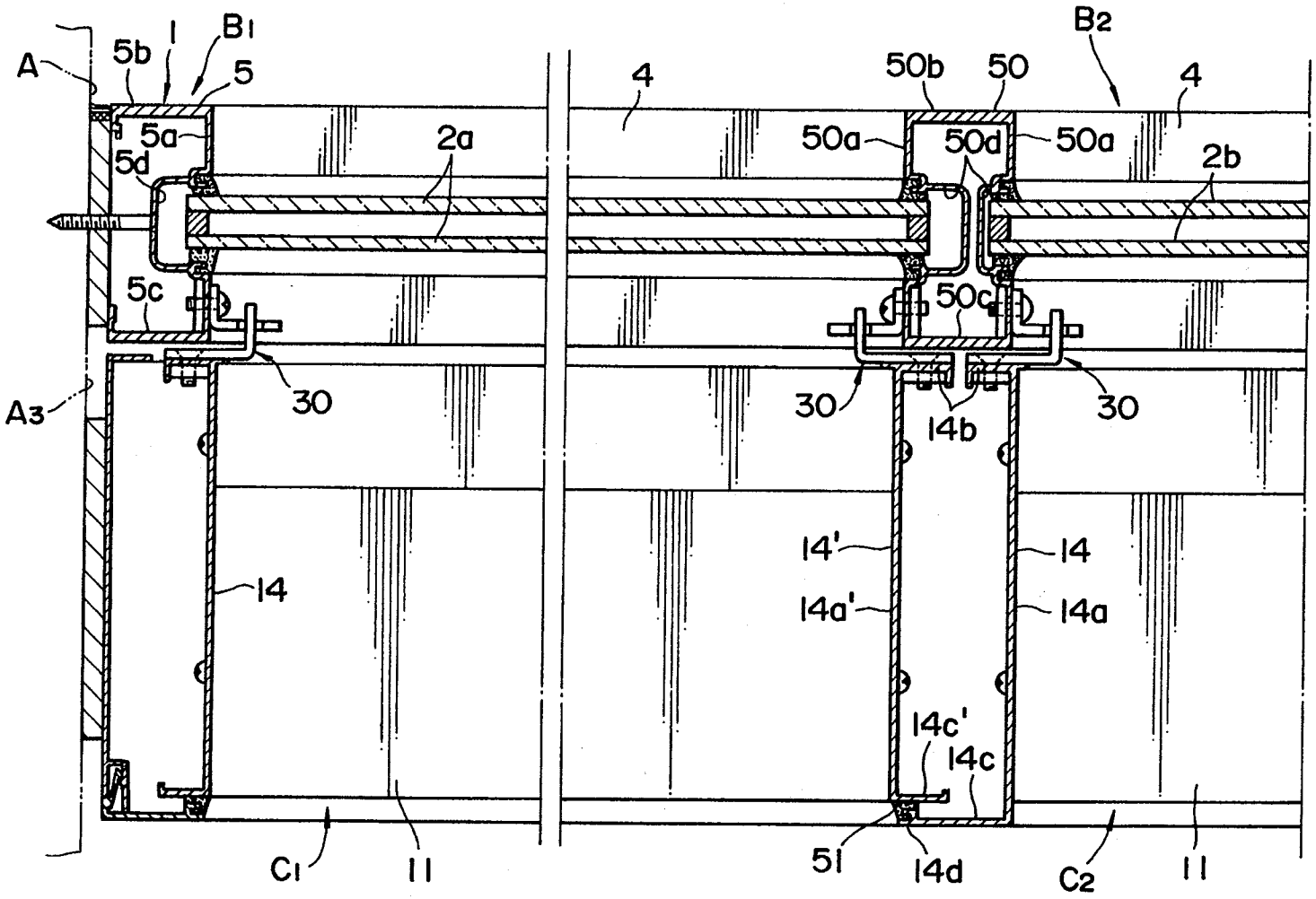
FIG. 4 is a horizontal cross-sectional view of another embodiment showing a multiple louvered window assembly.

A single louvered window assembly comprising a single fixed window unit B and single louver unit C has been dealt with so far. FIG. 4 shows a multiple louvered window assembly wherein a plurality of fixed window units B1, B2 and a plurality of louver units C1, C2 are fitted successively in a horizontal row in an elongated window opening A. More specifically, a plurality of intermediate window jambs 50 are provided between the window header (not shown) and the window sill 4, and arranged at uniform intervals longitudinally of the window opening A to provide a plurality of fixed window units B1, B2.

Each intermediate window jamb 50 is substantially rectangular in cross-section and comprises a front plate 50*c*, a rear plate 50*b* and a pair of side plates 50*a*, 50*a* each having the opposed ends connected to the corresponding ends of the front plate 50*c* and the rear plate 50*b*. A pair of inward-open recesses 50*d*, 50*d* are formed one in each side plate 50*a*, 50*a* of the intermediate window jamb 50. Double glass panes 2*a* are fitted between the recess 5*d* of the window jamb 5 and the recess 50*d* of the intermediate window jamb 50, and double glass panes 2*b* are also fitted between the opposed recesses 50*d*, 50*d* of the adjacent intermediate window jambs 50, 50 (only one jamb shown in FIG. 4).

As shown in FIG. 4, a corresponding number of louver units C1, C2 are fitted successively in a horizontal row in the opening A and arranged before their respective fixed window units B1, B2. The opposed louver stiles 14, 14' of the adjacent louver units C1, C2 have, on their respective longitudinal front edges, front flanges 14c, 14c' directed toward each other. The base plate 14a and the front flange 14c of one of the adjacent stiles 14, 14' (the right stile in FIG. 2) are wider than the base plate 14a' and the front flange 14c', respectively of the other stile 14' (the left stile), so that the front flanges 14c, 14c' of the adjacent stiles 14, 14' are offset and partly opposed relative to each other. The front flange 14c of the wider right stile 14 has on its rear surface, a groove 14d in which an intermediate gasket 51 is fitted. The intermediate gasket 51 comes into pressing engagement with the opposed surface of the front flange 14c of the left stile 14 so as to prevent infiltration of rain.

The louver units C1, C2 may be fitted one after another from any one side of the elongated window opening A.

Figure 5:
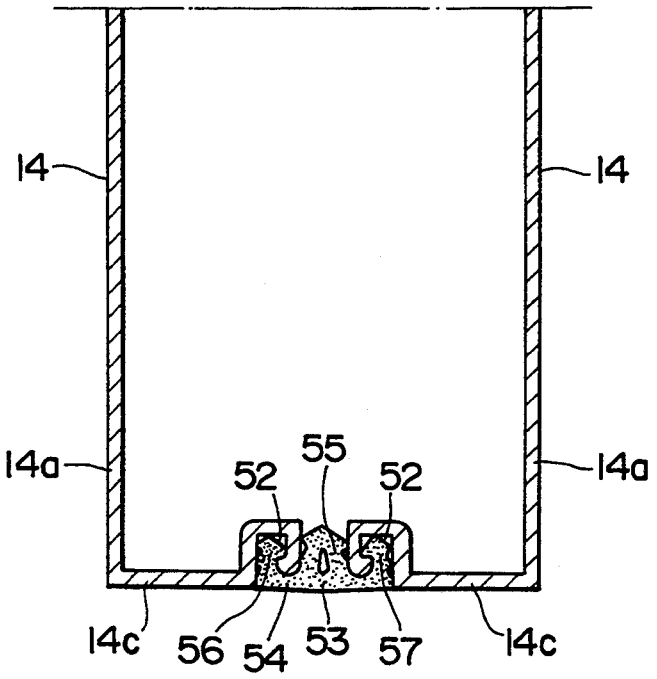
FIG. 5 is a fragmentary cross-sectional view of opposed louver stiles of the adjacent louver units to show sealing between the opposed louver stiles.

As shown in FIG. 5, the adjacent louver stiles 14, 14 may have the same width and have their respective front flanges 14c, 14c directed toward and held close to each other. Each flange 14c has in its distal edge a forward-open groove 52, so that the grooves 52, 52 of the adjacent stiles 14, 14 are both open forwardly in juxtaposed relation. An elongated gasket 53 is of a substantially E-shaped cross-section and comprises a base 54, a central body 55 provided on the middle of the base 54 and a pair of side lips 56 57 provided one on each side of the central body 55. The elongated gasket 53 is provided between the adjacent stiles 14, 14 with the side lips 56, 57 fitted into the respective grooves 52, 52 and with the central body 55 clamped between the front flanges 14c, 14c.

Obviously, the skilled person would realize that various modifications and variations of the present invention are possible in the light of the above teaching. It is therefore to be understood that within the scope of the appended claims the invention may be practiced otherwise than as specifically described, and that the invention is not limited to the embodiments described above in detail.

What is claimed is:

1. A louvered window assembly, comprising:

a fixed window unit (B) fixedly fitted on a rear side of a window opening (A), a louver unit (C) being slightly less in height and width than the window opening (A) and to be fitted on a front side of the window opening (A), and means for releasably fitting the louver unit (C) within the window opening (A);

the louver-unit fitting means comprising a support bracket (31) fastened to the front side of the fixed window unit (B), a hanger bracket (32) fastened to a rear side of the louver unit (C) and coming into engagement with the support bracket (31), a louver header (20) fastened to a front side of a vertical inside surface (A3) of the window opening (A), a pair of louver jambs (22, 22) fastened on the front side of each vertical inside surface (A3), an upper horizontal clip (40) joined to the front side of the header (20) so as to cover the front side of an upper edge of the louver unit (C), and a pair of vertical clips (45) joined one to the outside of each louver jamb so as to cover the outside of a lateral edge of the louver unit (C);

the fixed window unit (B) comprising a window frame (1) including a window header (3), a window sill (4) and a pair of window jambs (5, 5) each having its opposed ends joined to the corresponding ends of the window header (3) and the window sill (4), a glass pane (2) fitted into the window frame (1), and a pair of the support brackets (31, 31) being fastened to the front side of each window jamb (5); and the louver unit (C) comprising a louver frame (10) including a pair of upper and lower louver rails (12, 13), a pair of louver stiles (14, 14) each having its opposed ends joined to the corresponding ends of the upper and lower louver rails (12, 13), a plurality of louver slats (11) joined to the opposed louver stiles (14, 14) at substantially uniform intervals, a pair of the hanger brackets (32) fastened to a rear side of each louver stile (14), the upper horizontal clip (40) having on a lower edge a gasket (44) which comes into pressing engagement with the upper louver rail (12), and each vertical clip (45) having on an inner longitudinal edge a gasket (49) which comes into pressing engagement with the corresponding louver stile (14).

2. A louvered window assembly according to claim 1, the louver header (20) having on a front longitudinal edge a horizontal engaging groove (20c), the upper horizontal clip (40) having on an upper longitudinal edge an engaging ridge (42) adapted for engagement with the horizontal engaging groove (20c) of the louver header (20), each louver jamb (22) having on a front longitudinal edge a vertical engaging groove (22c), and each vertical clip (45) having on an outer longitudinal edge an engaging flange (47) for engagement with the vertical engaging groove (22c).

3. A louvered window assembly according to claim 1, the support bracket (31) being of an L-shaped cross-section and comprising an attaching wing (33) and a supporting wing (34) integrally formed substantially normal to the attaching wing (33) and having a cut (35) formed in its upper edge so as to be open upward: the hanger bracket (32) being also of an L-shaped cross-section and comprising an attaching wing (37) and a supporting wing (38) integrally formed substantially normal to the attaching wing (37) and having an indentation (39) formed in its lower edge so as to be open downward.

4. A louvered window assembly according to claim 1 further including an intermediate jamb (50) provided between the window header (3) and the window sill (4) and arranged at uniform intervals longitudinally in the window opening (A) to provide a plurality of fixed window units (B1, B2), a corresponding number of louver units (C1, C2) being fitted successively in a horizontal row and arranged before their respective fixed window units (B1, B2); the intermediate jamb (50) having a pair of support brackets (31, 31) one on each side thereof; and an intermediate gasket (51, 53) fitted between respective longitudinal front sides of the adjacent louver stiles (14, 14').

5. A louvered window assembly according to claim 4, one of the adjacent louver stiles (14, 14') being wider than the other stile (14') and having, on a longitudinal front edge, a front flange (14c) directed toward the other stile (14'); the intermediate gasket (51) being provided between the front flange (14c) of said one stile (14) and a front side of said other stile (14').

6. A louvered window assembly according to claim 4, said adjacent louver stiles (14, 14) having the same width and having, on their respective longitudinal front edges, a pair of front flanges (14*c*), (14*c*) directed toward and held close to each other, each flange having at its distal edge a forward-open groove (52) so that the grooves (52, 52) are both open forwardly in juxtaposed relation; the intermediate gasket (53) having a pair of side lips (56, 57) and placed between the adjacent stiles (14, 14) with the side lips (56, 57) fitted into the juxtaposed grooves (52, 52) of the adjacent stiles (14, 14).

* * * * *

UNITED STATES PATENT AND TRADEMARK OFFICE

CERTIFICATE OF CORRECTION

PATENT NO. : 5,353,565

DATED : October 11, 1994

INVENTOR(S) : Shinji TANIKAWA

It is certified that error appears in the above-indentified patent and that said Letters Patent is hereby corrected as shown below:

Title page,
Item 57, Abstract, line 18, "clip" should read --clips--.

Claim 6, column 9, line 4, "(14c), (14c)" should read --(14c, 14c)--.

Signed and Sealed this

Third Day of January, 1995

*Attest:*

BRUCE LEHMAN

*Attesting Officer*

*Commissioner of Patents and Trademarks*